US006339904B1

(12) United States Patent
Carrone et al.

(10) Patent No.: US 6,339,904 B1
(45) Date of Patent: Jan. 22, 2002

(54) SKIRT FOR A RAISED DWELLING

(76) Inventors: William F. Carrone, P.O. Box 533, Arabi, LA (US) 70032-0533; Donald J. Carrone, 401 Norton Ave., Arabi, LA (US) 70032

( * ) Notice: Subject to any disclaimer, the term of this patent is extended or adjusted under 35 U.S.C. 154(b) by 0 days.

(21) Appl. No.: 09/572,880

(22) Filed: May 19, 2000

(51) Int. Cl.[7] ..... E04D 2/38
(52) U.S. Cl. ..... 52/169.12; 52/169.1; 52/169
(58) Field of Search ..... 52/169.12; 160/35, 160/84.1, 84.04; 428/121, 100

(56) References Cited

U.S. PATENT DOCUMENTS

| | | | | |
|---|---|---|---|---|
| 3,256,655 A | | 6/1966 | Teeter | |
| 3,343,326 A | | 9/1967 | Sickler et al. | |
| 3,451,180 A | | 6/1969 | Struben | |
| 3,589,085 A | | 6/1971 | Sickler | |
| 4,107,888 A | | 8/1978 | Krueger | |
| 4,799,524 A | * | 1/1989 | Guermonprez | 160/84.1 |
| D355,494 S | | 2/1995 | Fenske | |
| 5,455,098 A | * | 10/1995 | Cheng | 428/121 |
| 6,047,759 A | * | 4/2000 | Lysyj | 160/84.04 |
| 6,059,004 A | * | 5/2000 | Oskam | 160/84.04 |
| 6,143,392 A | * | 11/2000 | Hughes | 428/100 |

* cited by examiner

*Primary Examiner*—Carl D. Friedman
*Assistant Examiner*—Basil Katcheves

(57) ABSTRACT

A skirt for a raised dwelling for restricting movement of air under a raised dwelling. The skirt for a raised dwelling includes a panel. The panel has a front side and a back side. The panel has a top edge and a bottom edge. The panel is corrugated such that pleat folds are defined. The pleat folds have ridge and valley lines orientated generally parallel to the top edge of the panel. The panel has a plurality of sets of apertures therein. Each of the sets of apertures is positioned along a line orientated generally perpendicular to the top and bottom edges of the panels. A space between each of the ridge and valley lines has one of the apertures therein. Each of a plurality of rods has a first end and a second end. The first ends are generally pointed. Each of the rods extends through one of the set of apertures, and the first ends of the rods are removably insertable in the ground.

6 Claims, 3 Drawing Sheets

SKIRT FOR A RAISED DWELLING

BACKGROUND OF THE INVENTION

1. Field of the Invention

The present invention relates to dwelling skirts and more particularly pertains to a new skirt for a raised dwelling for restricting movement of air under a raised dwelling.

2. Description of the Prior Art

The use of dwelling skirts is known in the prior art. More specifically, dwelling skirts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,343,326; U.S. Pat. No. 3,351,180; U.S. Pat. No. 3,589,085; U.S. Pat. No. 3,256,655; U.S. Pat. No. 4,107,888; and U.S. Des. Pat. No. 355,494.

While these devices fulfill their respective, particular objectives and requirements, the aforementioned patents do not disclose a new skirt for a raised dwelling. The inventive device includes a panel. The panel has a front side and a back side. The panel has a top edge and a bottom edge. The panel is corrugated such that pleat folds are defined. The pleat folds have ridge and valley lines orientated generally parallel to the top edge of the panel. The panel has a plurality of sets of apertures therein. Each of the sets of apertures is positioned along a line orientated generally perpendicular to the top and bottom edges of the panels. A space between each of the ridge and valley lines has one of the apertures therein. Each of a plurality of rods has a first end and a second end. The first ends are generally pointed. Each of the rods extends through one of the set of apertures, and the first ends of the rods are removably insertable in the ground.

In these respects, the skirt for a raised dwelling according to the present invention substantially departs from the conventional concepts and designs of the prior art, and in so doing provides an apparatus primarily developed for the purpose of restricting movement of air under a raised dwelling.

SUMMARY OF THE INVENTION

In view of the foregoing disadvantages inherent in the known types of dwelling skirts now present in the prior art, the present invention provides a new skirt for a raised dwelling construction wherein the same can be utilized for restricting movement of air under a raised dwelling.

The general purpose of the present invention, which will be described subsequently in greater detail, is to provide a new skirt for a raised dwelling apparatus and method which has many of the advantages of the dwelling skirts mentioned heretofore and many novel features that result in a new skirt for a raised dwelling which is not anticipated, rendered obvious, suggested, or even implied by any of the prior art dwelling skirts, either alone or in any combination thereof.

To attain this, the present invention generally comprises a panel. The panel has a front side and a back side. The panel has a top edge and a bottom edge. The panel is corrugated such that pleat folds are defined. The pleat folds have ridge and valley lines orientated generally parallel to the top edge of the panel. The panel has a plurality of sets of apertures therein. Each of the sets of apertures is positioned along a line orientated generally perpendicular to the top and bottom edges of the panels. A space between each of the ridge and valley lines has one of the apertures therein. Each of a plurality of rods has a first end and a second end. The first ends are generally pointed. Each of the rods extends through one of the set of apertures, and the first ends of the rods are removably insertable in the ground.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new skirt for a raised dwelling apparatus and method which has many of the advantages of the dwelling skirts mentioned heretofore and many novel features that result in a new skirt for a raised dwelling which is not anticipated, rendered obvious, suggested, or even implied by any of the prior art dwelling skirts, either alone or in any combination thereof.

It is another object of the present invention to provide a new skirt for a raised dwelling which may be easily and efficiently manufactured and marketed.

It is a further object of the present invention to provide a new skirt for a raised dwelling which is of a durable and reliable construction.

An even further object of the present invention is to provide a new skirt for a raised dwelling which is susceptible of a low cost of manufacture with regard to both materials and labor, and which accordingly is then susceptible of low prices of sale to the consuming public, thereby making such skirt for a raised dwelling economically available to the buying public.

Still yet another object of the present invention is to provide a new skirt for a raised dwelling which provides in the apparatuses and methods of the prior art some of the advantages thereof, while simultaneously overcoming some of the disadvantages normally associated therewith.

Still another object of the present invention is to provide a new skirt for a raised dwelling for restricting movement of air under a raised dwelling.

Yet another object of the present invention is to provide a new skirt for a raised dwelling which includes a panel. The panel has a front side and a back side. The panel has a top edge and a bottom edge. The panel is corrugated such that pleat folds are defined. The pleat folds have ridge and valley lines orientated generally parallel to the top edge of the panel. The panel has a plurality of sets of apertures therein. Each of the sets of apertures is positioned along a line orientated generally perpendicular to the top and bottom edges of the panels. A space between each of the ridge and valley lines has one of the apertures therein. Each of a plurality of rods has a first end and a second end. The first ends are generally pointed. Each of the rods extends through one of the set of apertures, and the first ends of the rods are removably insertable in the ground.

Still yet another object of the present invention is to provide a new skirt for a raised dwelling that may be retrofitted to any raised dwelling and efficiently sizable to the lengths needed.

Even still another object of the present invention is to provide a new skirt for a raised dwelling that has a fastening means for fastening the panel to the dwelling and for blocking the site of the panel when the panel is in a raised position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
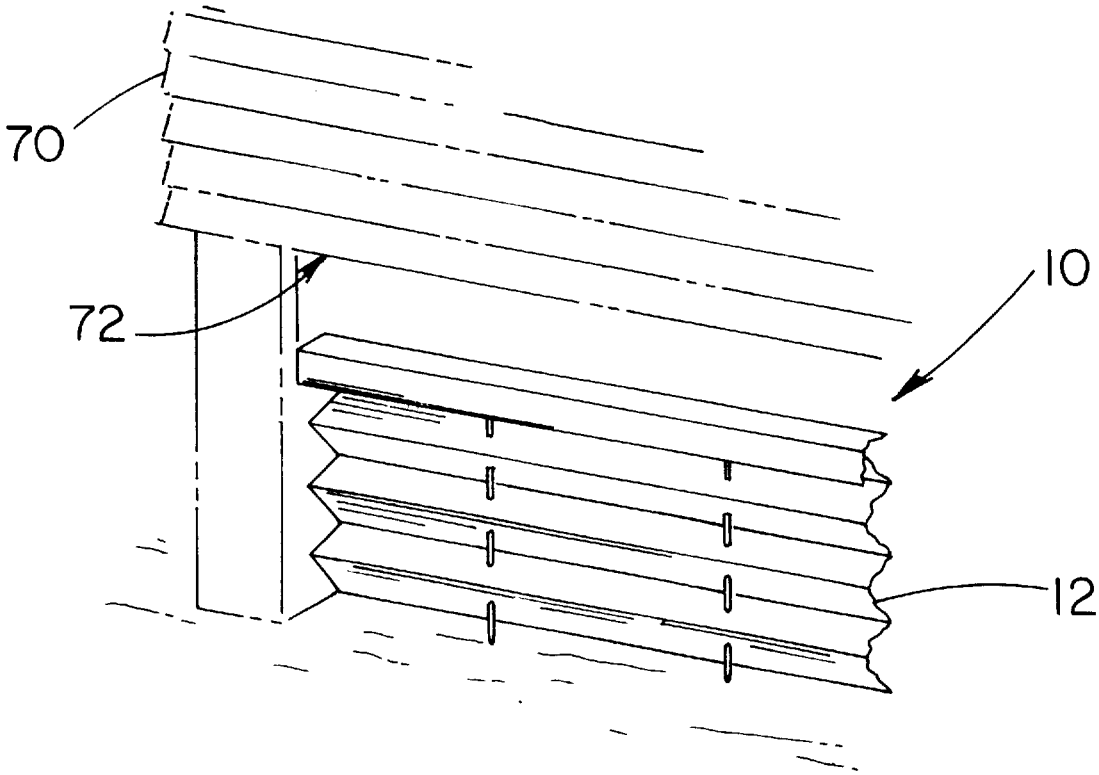
FIG. 1 is a schematic perspective view of a new skirt for a raised dwelling according to the present invention.
Figure 2:
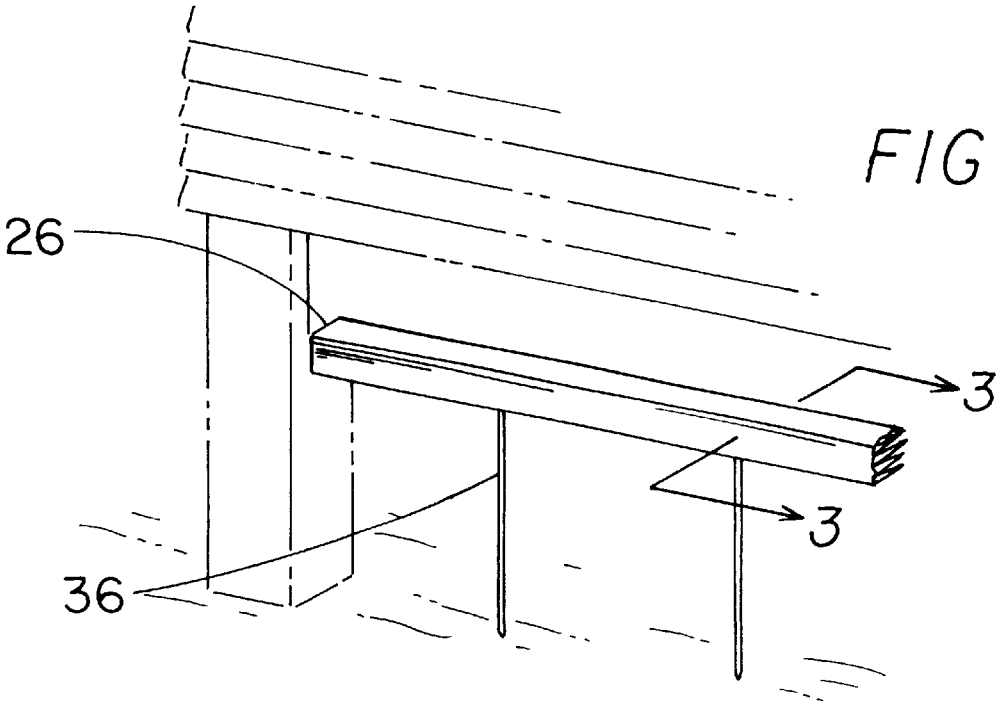
FIG. 2 is a schematic perspective view of the present invention.

With reference now to the drawings, and in particular to FIGS. 1 through 5 thereof, a new skirt for a raised dwelling embodying the principles and concepts of the present invention and generally designated by the reference numeral 10 will be described.

As best illustrated in FIGS. 1 through 5, the skirt for a raised dwelling 10 generally comprises a panel 12. The panel 12 has a front side and a back side. The panel 12 has a top edge 14 and a bottom edge 16. The panel 12 is corrugated such that pleat folds are defined. The pleat folds have ridge 18 and valley 20 lines orientated generally parallel to the top edge 14 of the panel 12. The panel 12 has a plurality of sets of apertures 22 therein. Each of the sets of apertures 22 is positioned along a line orientated generally perpendicular to the top 14 and bottom 16 edges of the panels 12. Ideally, the spaces for the apertures are formed by perforations 24 in the panel 12 such that only the amount of sets of apertures 22 needed may be used. A space between each of the ridge 18 and valley 20 lines has one of the apertures 22 therein. The panel 12 comprises a resiliently flexible material, which is preferably a plastic.

A fastening means 26 fastens the panel to a bottom edge 72 of a dwelling 70 which is raised above the ground. The fastening means is elongated, and has a first wall 28 integrally coupled to a second wall 30. The first 28 and second 30 walls are orientated generally perpendicular to each other, such that the fastening means 26 has an L-shaped cross-section taken transverse to a longitudinal axis of the fastening means 26. The first wall 28 is coupled to the dwelling 70 with a coupling means 32, such as a screw or nail, so that the second wall 30 extends downwardly from the dwelling 70. The top edge 14 of the panel 12 is fixedly coupled to the first wall 28 such that the panel 12 extends downwardly from the dwelling 70. The fastening means 26 is orientated such that the second wall 30 has an outside surface 34 facing away from the dwelling 70 such that the second wall 30 shields the panel 12 from view when it is in a collapsed position as shown in FIG. 3.

Each of a plurality of rods 36 has a first end 38 and a second end 40. The first end 38 is generally pointed, and each of the rods 36 extends through one of the set of apertures 22. The second ends 40 are removably coupled to the first wall 28 of the fastening means 26. The first ends 38 of the rods are removably insertable in the ground.

Figure 3:
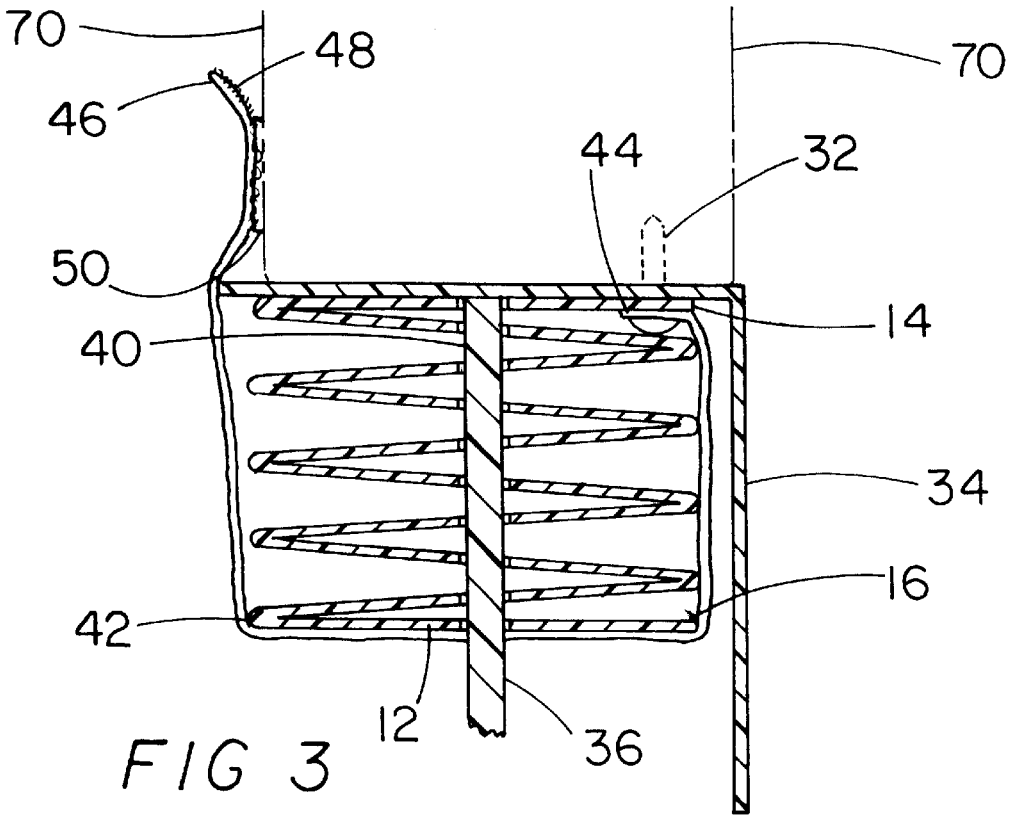
FIG. 3 is a schematic side-cross sectional view taken along line 3—3 of the present invention.
Figure 4:
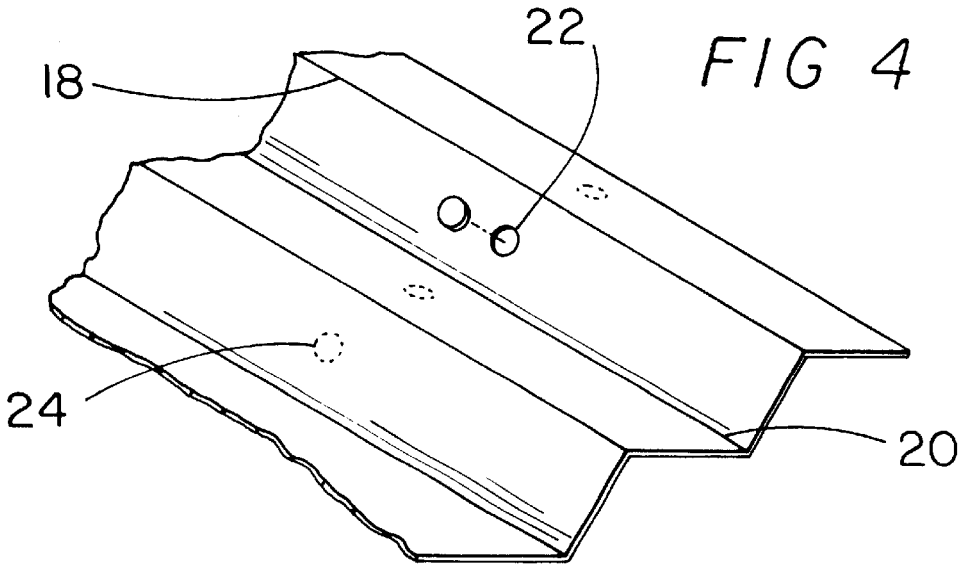
FIG. 4 is a schematic perspective view of the panel of the present invention.
Figure 5:
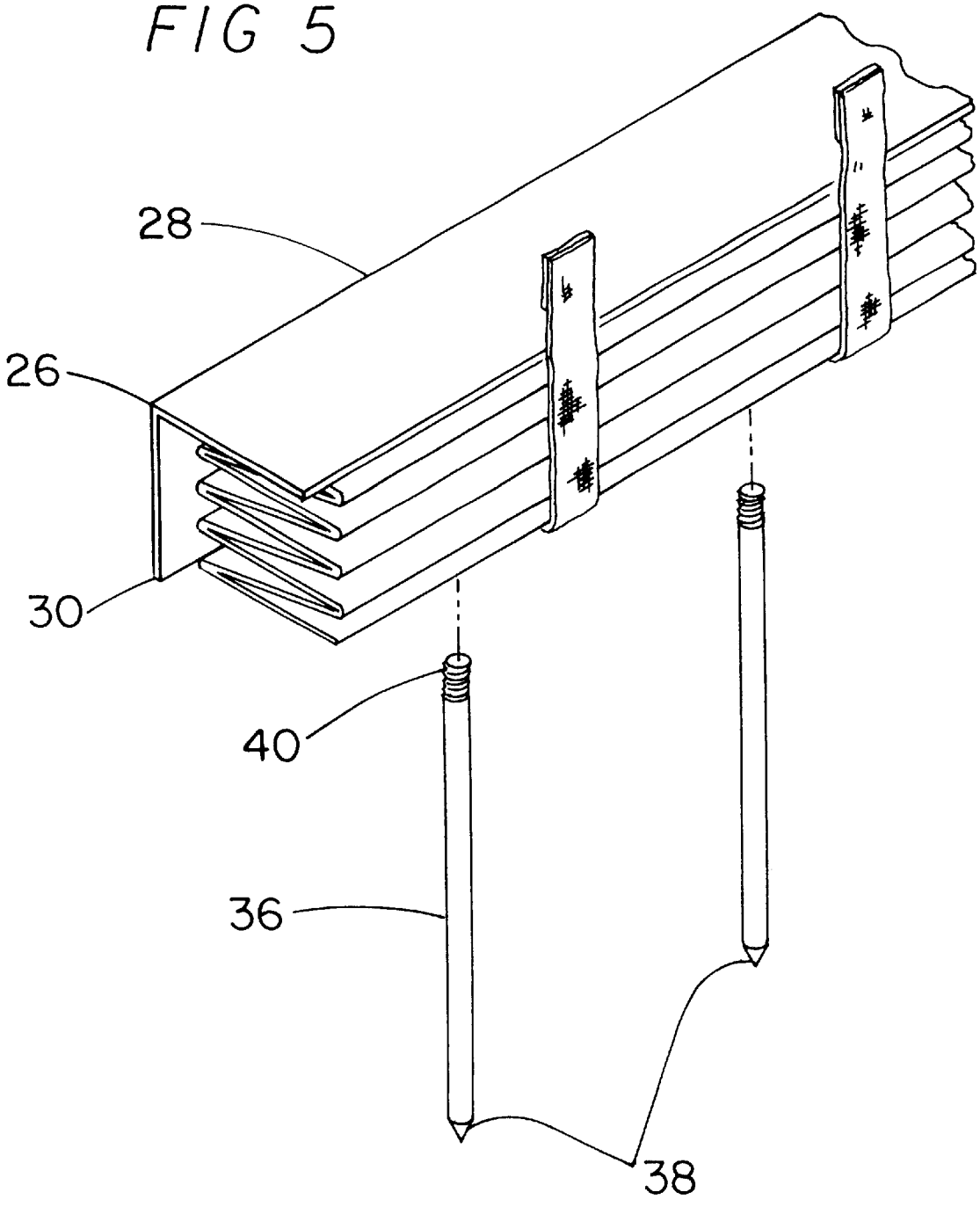
FIG. 5 is a schematic perspective view of the present invention.

A securing means 42 selectively secures the panel 12 in a compacted position as shown in FIG. 3. The securing means 42 comprises a plurality of straps. Each of the straps has a first end 44 a second end 46. Each of the first ends 44 is fixedly coupled to the top edge 14 of the panel 12 and is positioned between the panel and the second wall 30. Each of the second ends 46 is removably fastened to the dwelling 70 by hook and loop fastening means. The hook portions 48 are fixedly coupled to the straps and positioned generally adjacent to the second ends 46. The loop portions 50 are fixedly coupled to the dwelling 70 and positioned such that the hook portion 48 may communicate with the loop portion 50.

In use, the panels 12 are coupled to the dwelling 70 using the fastening means 26, which also acts as a visual shield when the panels are in a compacted position. The rods 36 stabilize the panels 12 so that they do not move with airflow. The panels 12 are positioned around the perimeter of the dwelling 70 and are placed in an extended position to restrict movement of air under the dwelling. This restriction promotes conservation of heat within the dwelling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A home skirting device for restricting air-flow below a raised dwelling, said device comprising:

a panel having a front side and a back side, said panel having a top edge and a bottom edge, said panel being corrugated such that pleat folds are defined, said pleat folds having ridge and valley lines orientated generally parallel to said Lop edge of said panel, said panel having a plurality of sets of apertures therein, each of said sets of apertures being positioned along a line orientated generally perpendicular to said top and bottom edges of said panels; wherein a space between each of said ridge and valley lines has one of said apertures therein;

a plurality of rods, each of said rods having a first end and a second end, said first ends being generally pointed, each of said rods extending through one of said set of apertures, said first ends of said rods being removably insertable in the ground;

a fastening means for removably fastening said panel to the dwelling being attached to said top edge of said panel; and wherein each of said second ends of said rods is removably attached to said fastening means and said bottom edge of said panel is selectively positionable between a position generally adjacent to said fastening means and a position abutting the ground.

2. The home skirting device as in claim 1, wherein said fastening means is elongated and includes a first wall integrally coupled to a second wall, said first and second walls being orientated generally perpendicular to each other, said fastening means having an L-shaped cross-section taken transverse to a longitudinal axis of said fastening means, said first wall being coupled to said dwelling with a coupling means such that said second wall extends downwardly from said dwelling, said top edge of said panel being fixedly coupled to said first wall.

3. The home skirting device as in claim 2, wherein each of said second ends is removably coupled to said first wall of said fastening means, said first ends of said rods being removably insertable in the ground.

4. The home skirting device as in claim 2, further comprising:

a securing means for selectively securing said panel in a compacted position, said securing means comprising a plurality of straps, each of said straps having a first end a second end, each of said first ends being fixedly coupled to said top edge of said panel and being positioned between said panel and said second wall, each of said second ends being removably fastenable to said dwelling by a fastening means such that said strap may be wrapped about said bottom edge of said panel.

5. A home skirting device for restricting air-flow below a raised dwelling, said device comprising:

a panel having a front side and a back side, said panel having a top edge and a bottom edge, said panel being corrugated such that pleat folds are defined, said pleat folds having ridge and valley lines orientated generally parallel to said top edge of said panel, said panel having a plurality of sets of apertures therein, each of said sets of apertures being positioned along a line orientated generally perpendicular to said top and bottom edges of said panels; wherein a space between each of said ridge and valley lines has one of said apertures therein, said panel comprising a resiliently flexible material, said flexible material being a plastic;

a fastening means for fastening said panel to the dwelling, said fastening means being elongated, said fastening means having a first wall integrally coupled to a second wall, said first and second walls being oriented generally perpendicular to each other, said fastening means having an L-shaped cross-section taken transverse to a longitudinal axis of said fastening means, said first wall being coupled to said dwelling with a coupling means such that said second wall extends downwardly from said welling, said to edge of said panel being fixedly coupled to said first wall such that said panel extends downwardly from said dwelling, said fastening means being oriented such that said second wall has an outside surface facing away from the dwelling;

a plurality of rods, each of said rods having a first end and a second end, said first ends being generally pointed, each of said rods extending through one of said set of apertures, said second ends being removably coupled to said first wall of said fastening means, saaid first ends of said rods being removably insertable in the ground;

a securing means for selectively securing said panle in a compacted position, said securing means comprising a plurality of straps, each of said straps having a first end a second end, each of said first ends being fixedly coupled to said top edge of sadi panel and being positioned between said panel and said second wall, each of said second ends being removably fastened to said dwelling by hook and loop fastening means, said hook portions being fixedly coupled to said straps and positioned generally adjacent to said second ends, said loop portions being fixedly coupled to said dwelling and positioned such that said hook portion may communicate with said loop portion; and wherein there are a plurality of said devices.

6. A home skirting device comprising in combination:

a raised dwelling such that a space is defined between a bottom edge of said dwelling and aground surface;

a panel having a front side and a back side, said panel having a top edge and a bottom edge, said panel being corrugated such that pleat folds are defined, said pleat folds having ridge and valley lines orientated generally parallel to said top edge of said panel, said panel having a plurality of sets of apertures therein, each of said sets of apertures being positioned along a line orientated generally perpendicular to said top and bottom edges of said panels, wherein a space between each of said ridge and valley lines has one of said apertures therein;

a plurality of rods, each of said rods having a first end and a second end, said first ends being generally pointed, each of said rods extending through one of said set of apertures, said first ends of said rods being removably insertable in the ground;

a fastening means for removably fastening said panel to said dwelling being attached to said top edge of said panel; and wherein each of said second ends of said rods is removably attached to said fastening means and said bottom edge of said panel is selectively positionable between a position generally adjacent to said fastening means and a position abutting the ground to cover said space.

* * * * *